United States Patent [19]

Aoki

[11] Patent Number: 4,502,220

[45] Date of Patent: Mar. 5, 1985

[54] HAND-HELD TYPE OPENING AND CLOSING ACTION TOOL

[76] Inventor: Takaaki Aoki, 8-D-329, 8-2-Chome, Nakatsu, Ohyodo-Ku, Osaka-Shi, Osaka-Fu, Japan

[21] Appl. No.: 448,602

[22] Filed: Dec. 10, 1982

[30] Foreign Application Priority Data

Dec. 10, 1981 [JP] Japan ..... 56/199724
Dec. 10, 1981 [JP] Japan ..... 56/199725

[51] Int. Cl.[3] ..... B26B 13/00
[52] U.S. Cl. ..... 30/154; 30/162
[58] Field of Search ..... 30/152, 162, 252, 233, 30/253, 154, 155, 163, 244, 245, 255

[56] References Cited

U.S. PATENT DOCUMENTS

| | | | |
|---|---|---|---|
| 31,032 | 1/1861 | Reist | 30/255 |
| 235,726 | 12/1880 | Benson | 30/162 X |
| 542,601 | 7/1895 | Baker | 30/162 |
| 1,583,909 | 5/1926 | Wright | 30/162 X |
| 2,270,655 | 1/1942 | Keeran | 30/162 |
| 2,885,779 | 5/1959 | Newkirk | 30/162 |
| 4,203,208 | 5/1980 | Tausendfreundt et al. | 30/155 |
| 4,400,877 | 8/1983 | Gingher, Jr. | 30/253 |

FOREIGN PATENT DOCUMENTS 49-3186 1/1974 Japan .

*Primary Examiner*—Frank T. Yost
*Attorney, Agent, or Firm*—Armstrong, Nikaido, Marmelstein & Kobovcik

[57] ABSTRACT

The present invention relates to a hand-held type opening and closing action tool in the form having front active pieces for cutting and other operations adapted to perform opening and closing motion around the axis of a pivot, as found in manual sharp-edged tools and manual tools, such as scissors, pliers, nippers, and strippers. The tool comprises a hand-holdable cover case formed with an elongated guide hole, opening and closing operation levers pivotally mounted on the case and normally resiliently urged in the direction to spread out from the case, and front active pieces operatively connected to the levers to bear the resilient force on the levers and adapted to be opened and closed by the levers, the arrangement being such that the levers are prostrated into the sunken state in the case against the resilient force and in this state the pivot of the pieces is slid along the elongated guide hole of the case, whereby the pieces are also received in the case in the sunken state.

6 Claims, 15 Drawing Figures

HAND-HELD TYPE OPENING AND CLOSING ACTION TOOL

BACKGROUND OF THE INVENTION

Generally, hand-held type opening and closing action tools having a mechanism for cutting or expanding or contracting an article by means of front active pieces adapted to perform opening and closing motion around the axis of a pivot are in wide use as manual sharp-edged tools typified by various types of scissors and as manual tools such as pliers, nippers and strippers. The front active pieces are usually made of metal material, worked into sharp blades or pointed pins or jaws, entailing the danger of nipping and hurting the user's fingers.

To speak of scissors, for example, the conventional scissors are so arranged that a cutting blade serving as a front active piece and an opening and closing operation lever forming a base end arm are made into a continuous integral rigid body and such a pair are pivotally connected together by a pivot in the intermediate region thereof. Although the pair of cutting blades are maintained in the closed state when the scissors are not in use, nevertheless the cutting edges are left exposed and still dangerous and it is unsuitable for the user to carry about him the scissors in the exposed state received in the pocket of his garment or in his bag. Even if the scissors have a mechanism for locking the sharp cutting blades in their closed state, they can hardly be said to be safe unless the cutting blades are covered.

Thus, it may be contemplated to receive the whole scissors completely in a case or cover the cutting blades alone as by a sheath in the same manner as when they are displayed for sale in a shop. However, such a case or sheath is separate from the scissors, so that it is necessary to additionally prepare the same. Even if it is prepared as an auxiliary, it would be troublesome to put in and out the scissors and the auxiliary would often be lost. Furthermore, even if the scissors are stored in such a case or sheath, the scissors do not become compact; on the contrary, they become more bulky. The scissors would move freely in the case or sheath, which is inconvenient to carry about.

SUMMARY OF THE INVENTION

The present invention provides a hand-held type opening and closing action tool which is useful to solve these problems, and more particularly it provides a hand-held type opening and closing action tool in the form having front active pieces for cutting and other operations adapted to perform opening and closing motion around the axis of a pivot, as found in manual sharp-edged tools typified by said scissors and other manual tools.

Accordingly, a first object of the invention is to provide such a tool wherein the front active pieces embodied in said cutting blades are formed separate from their opening and closing operation levers, said pieces and levers being assembled so that they can be received in the sunken state in a portable cover case, thus allowing the user to carry about him the tool safety in the small compact folded state without requiring any exclusive-purpose packing case or sheath.

A second object is to provide such a tool wherein front active pieces and their opening and closing operation levers are operatively connected together and normally resiliently urged to spread out from a cover case, while a pivot used to assemble the pieces to the case is slidably fitted in an elongated slide guide hole in the case, so that by simply sliding the pivot for the pieces in the longitudinal direction by a finger tip of the user's hand which grips the case, the sunken state of the pieces and levers and the extended state thereof can be lightly and correctly switched from one to the other.

A third object of the invention is to provide such a tool wherein piece opening and closing operation levers, in a pair, serve as a cover case and defined an elongated slide guide hole therebetween when they are prostrated and closed in opposed relation to each other, with the pivot for the pieces being fitted in said elongated guide hole, thereby dispensing with the separate cover case for the attainment of said object and maximizing its effect of mass-production.

Other objects of the invention will become clear from the following description of embodiments thereof.

BRIEF DESCRIPTION OF THE DRAWINGS

The drawings illustrate the present invention applied to two types of scissors.

FIG. 1 is an external side view of the scissors during use;

FIG. 2 is a side view of the same in the lid-opened state;

FIG. 3 is a side view in the lid-opened state, seen in the opposite direction to FIG. 2;

FIG. 4 is an enlarged section taken along the line 4—4 of FIG. 1;

FIG. 5 is an external side view with operating levers closed;

FIG. 6 is a side view in the lid-opened state, with front active pieces stored;

FIG. 7 is a front view of FIG. 6;

FIG. 8 is an enlarged section taken along the line 8—8 of FIG. 6;

FIG. 9 is a section taken along the line 9—9 of FIG. 7.

FIG. 10 is an external side view of the scissors during use;

FIG. 11 is an external side view with the operating levers closed;

FIG. 12 is an external side view with the active pieces stored;

FIG. 13 is an enlarged front view of FIG. 12;

FIG. 14 is an enlarged section taken along the line 14—14 of FIG. 12;

and

Figure 1:
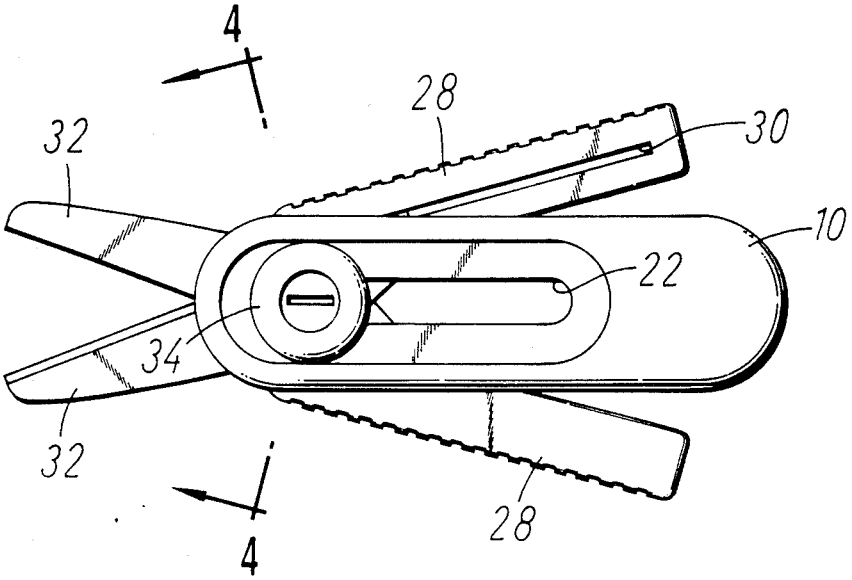
FIGS. 1 through 9 show scissors according to the basic embodiment of the invention.
Figure 2:
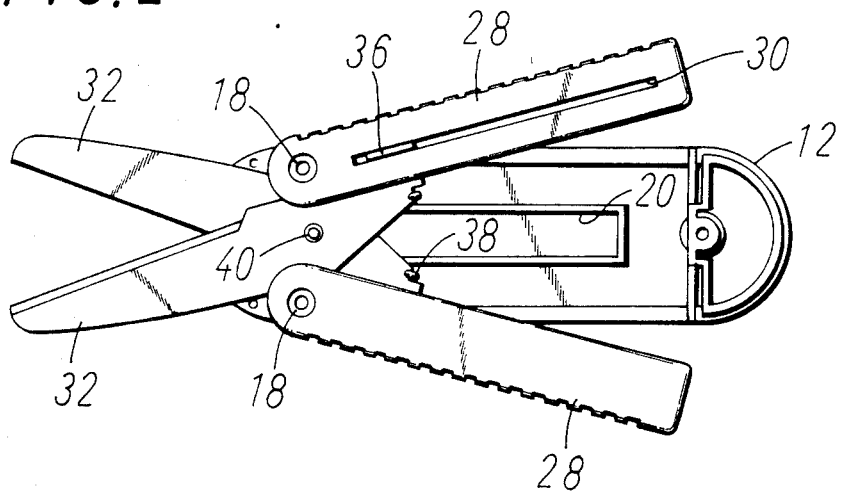
Figure 3:
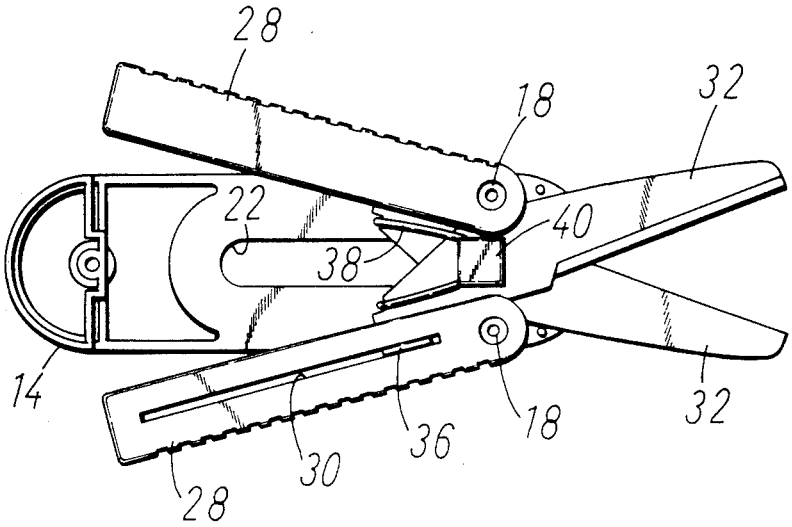
Figure 4:
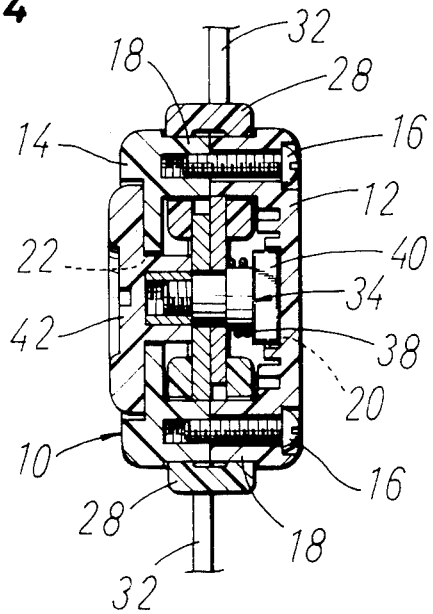
Figure 5:
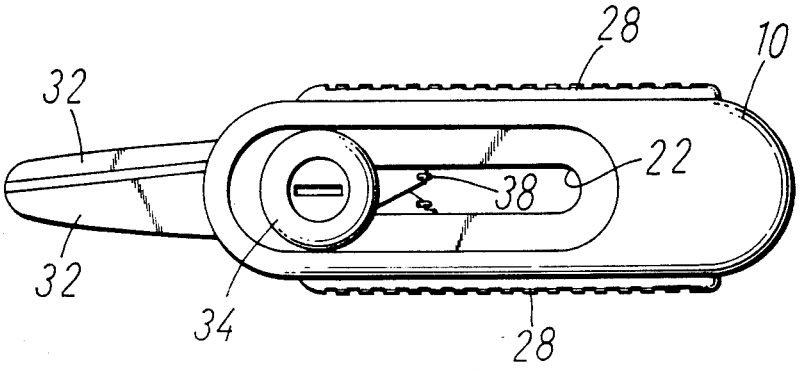
Figure 6:
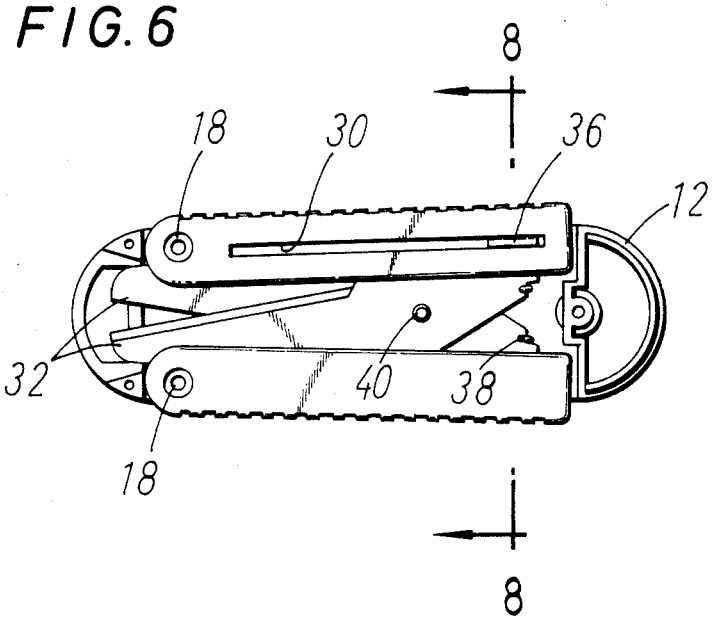
Figure 7:
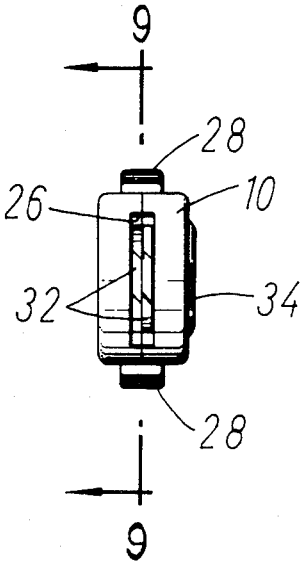
Figure 8:
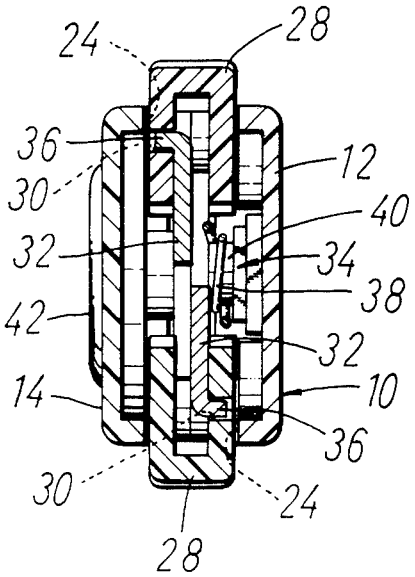
Figure 9:
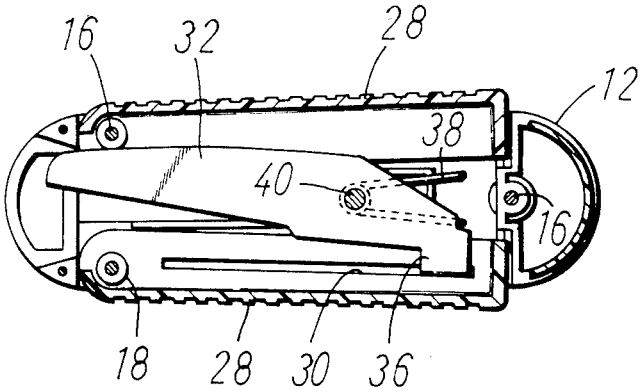
Figure 10:
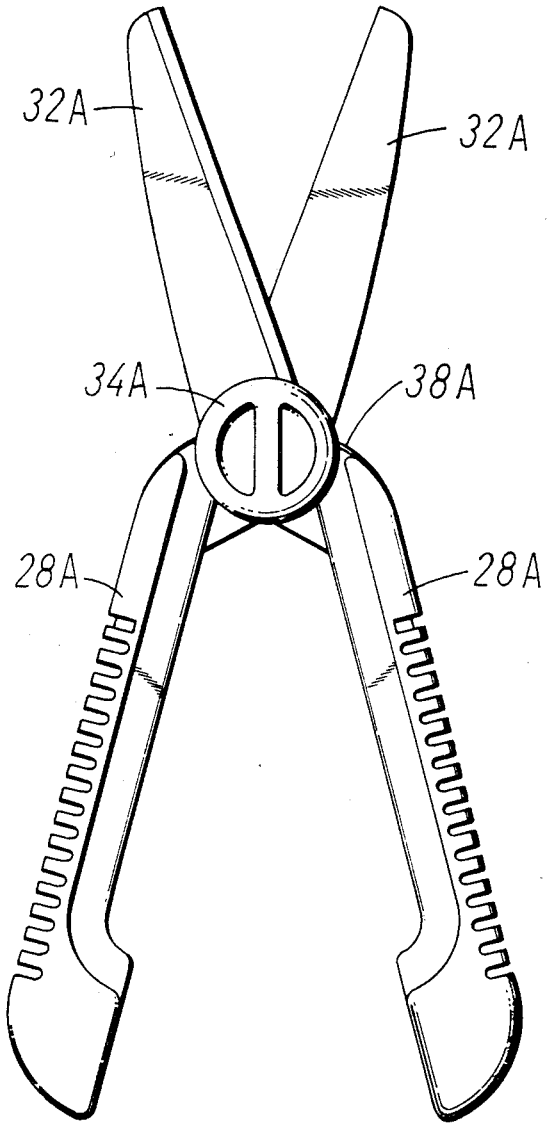
FIGS. 10 through 15 illustrate a modification of the scissors.
Figure 11:
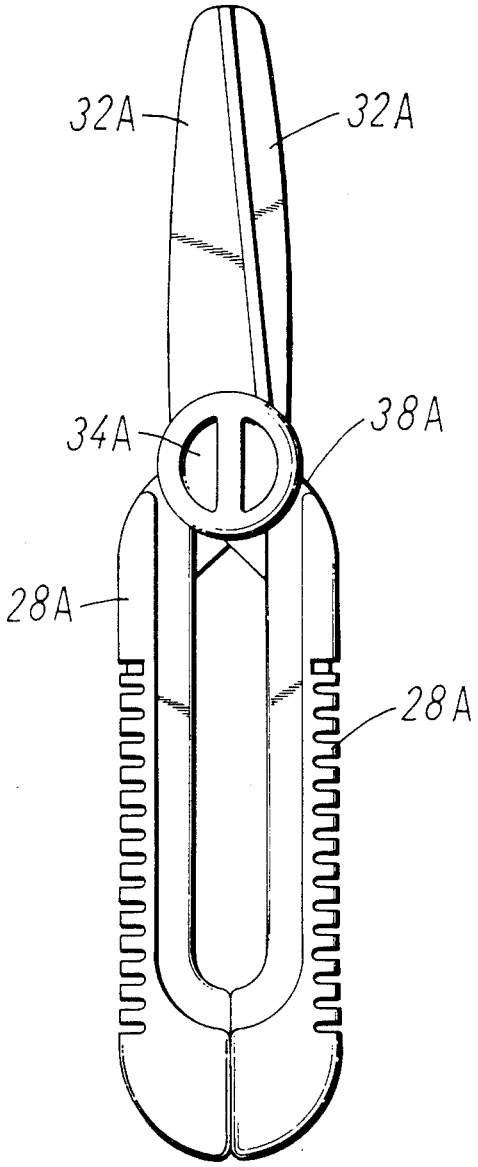
Figure 12:
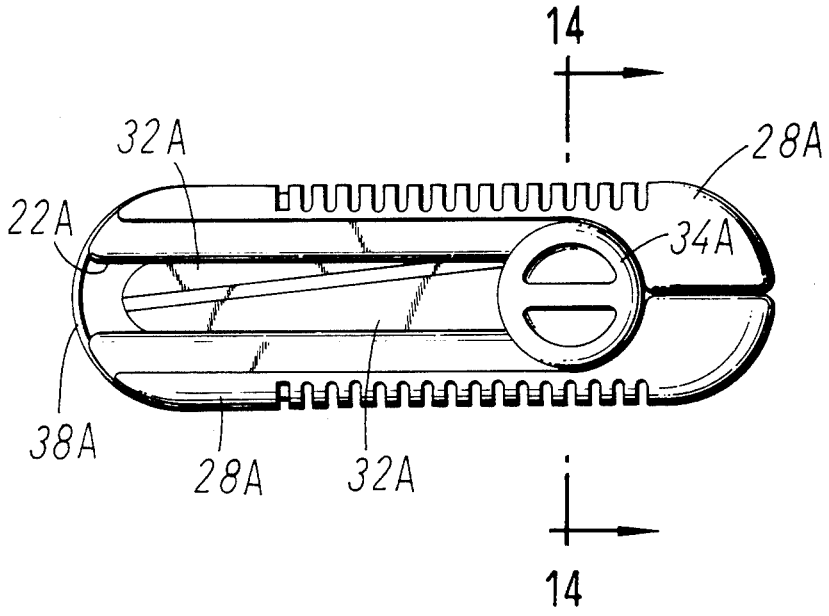
Figure 13:
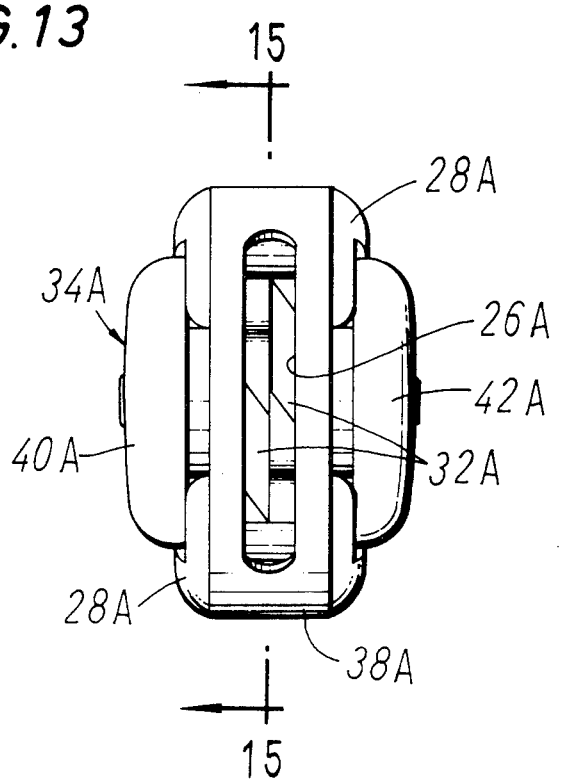
Figure 14:
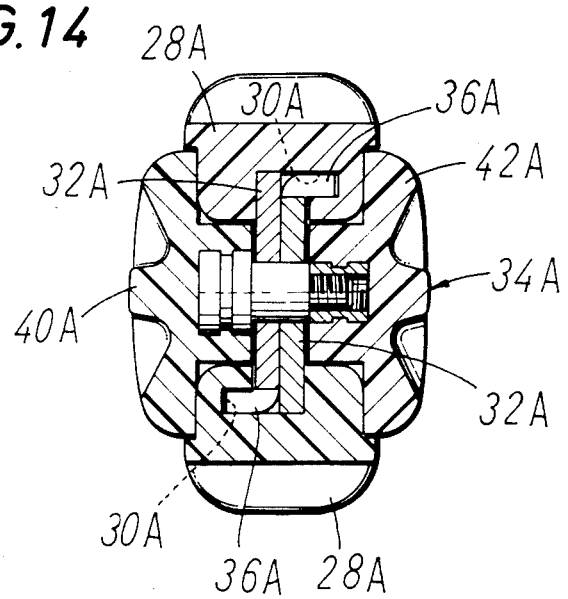
Figure 15:
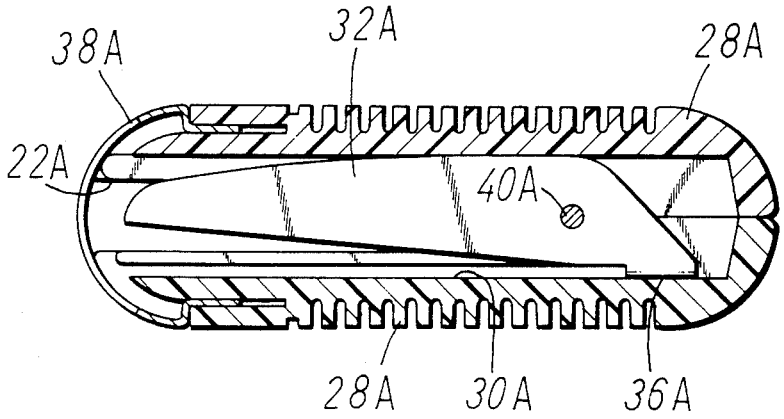

FIG. 15 is a reduced section taken along the line 15—15 of FIG. 13.

DESCRIPTION OF THE PREFERRED EMBODIMENTS

The drawings illustrate the present invention embodied in scissors. Referring to FIGS. 1 through 9 showing the basic form of the invention, 10 denotes a cover case serving the function of a grip which can be grasped by one hand; it is made of metal or preferably of synthetic resin and may sometimes be colored. The case 10 consists of two parts which are put together substantially in a manner in which one presses one's open hands in prayer; thus, the parts define a hollow space therebetween in which front active pieces and opening and closing operation levers thereof, to be later described, are received.

The numeral 12 denotes a case body which is one of said two divisional parts, and 14 denotes a lid body forming the other part, the two being separably clamped together by a plurality of screws 16 (3 screws, in the figures). The screws 16 are driven into columns extending inwardly horizontally from the case body 12 and lid body 14. In this instance, the two columns for receiving the screws 16, located one above the other in the front region of the case 10, serve as pivots 18 for the operating levers to be later described. As a result, even if the screws 16 are removed, the levers will not instantly fall off from the pivots 18, so that assembly and disassembly operations can be conveniently carried out.

The numeral 20 denotes a slide guide groove formed at the inner surface of the lateral wall of the case body 12 and extending lengthwise of the case 10. The numeral 22 denotes an elongated slide guide formed through the lateral wall of the lid body 14 and also extending in the direction of the length in exactly opposed and parallel relation to the guide groove 20. The open length of the guide groove 20 and elongated guide hole 22 is, of course, sufficient to allow the active pieces to be later described to sink into the interior of the case 10. The upper and lower walls of the case 10 formed by assembling the case body 12 and lid body 14 are formed with a lever passage opening 24 and the front wall is formed with a piece passage opening 26.

In the drawings, the case 10 is formed of the divisional case body 12 and lid body 14 and one part is named the case body and the other part the lid body for the convenience of description; however, one part may be made in the form of a deep box and the other part in the form of a simple flat plate, so as to constitute a similar case. Alternatively, the two parts may be symmetrical and the guide groove 20 may be extended through the wall exactly in the same manner as the elongated guide hole 22. At any rate, the active pieces and operating levers to be later described are assembled along with the assembly of the case 10 and clamped between the case body 12 and lid body 14, so that they will never come off.

The numeral 28 denotes a pair of opening and closing operation levers made of metal or preferably of synthetic resin and are rotatably fitted on aforesaid pivots 18 at their front ends. Instead of using the pivots 18 provided by the columns of the case 10, the front ends of the levers 28 may be shaped as arcuate surfaces which are then kept in contact with the arcuate inner surface of the front wall of the case 10, thereby making it possible to pivotally support the levers 28 on the case 10. The pair of levers 28 have the same U-shaped cross-section and are assembled to the case 10 in such a manner that they are vertically opposed to each other in reversed relation. Thus, the open portion of the U-shaped cross-section is directed downwardly for one lever 28 and upwardly for the other lever 28. The numeral 30 denotes a piece-receiving long groove formed in the lever 28 of U-shaped cross-section and extending lengthwise of the lever 28. It has the rear end of a piece removably and slidably fitted therein.

The numeral 32 denotes a pair of front active pieces made of metal forming the cutting blades of the scissors and adapted to cut an object by their front cutting edges. The numeral 34 denotes a pivot for assembling the pair of pieces 32 to the case 10, and the pieces 32 turn around the axis of said pivot. The numeral 36 denotes an engaging arm continuously formed at the rear end of the piece 32 and bent in L shape, said arm being slidably fitted in aforesaid receiving long groove 30 of the lever 28. The numeral 38 denotes a coil spring for constantly urging the two pieces 32 to spread out and having its ends separately locked to the rear ends of the pieces 32. Thus, the resilient force is also borne by the levers 28, so that the pair of levers 28 are also constantly urged to spread out from the case 10. That is, the pieces 32 and their opening and closing operation levers 28, though separate from each other, are operatively connected to each other.

The pivot 34 for the pieces 32 serves as a screw clamp body consisting of a polygon-headed bolt 40 and a cap nut 42 screwed thereon and extends transversely within the case 10. In this instance, the polygonal head of the bolt 40 is slidably fitted in the guide groove 20 of the case body 12, and the synthetic resin grip portion of the cap nut 42 is disposed outside the elongated guide hole 22 of the lid body 14, so that it can be longitudinally slid by the finger tip or rotated with respect to the bolt 40. That is, by operating the pivot 34 from the outside to slide it along the elongated guide hole 22 of the case 10, it is possible to effect switching between the sunken state and the extended state of the pieces 32 with respect to the case 10. In each of the states, it is possible to tighten the cap nut 42 with respect to the bolt 40 to press the grip portion thereof against the outer surface of the lateral wall of the case 10, thereby locking it to prevent its slide movement.

The opening and closing action of the scissors will be described on the basis of the arrangement described above. In use, as is clear from FIGS. 1 through 5, the pieces 32 and their opening and closing operation levers 28 are under the action of the resilient force of the coil spring 38 and thereby urged to spread out from the case. Thus, the operator manipulates the levers 28 by his hand which grips the case 10, thereby opening and closing the forwardly extending pieces 32 to cut the object correctly.

When it is desired to carry or store the scissors, the user slides the pivot 34 of the pieces 32 backwardly along the elongated guide hole 22 of the case 10 by a finger tip of his hand which squeezes the levers 28. Thus, the pieces 32, while engaging the piece-receiving long groove 30 of the lever 28, slides into the sunken state in the case 10 while maintaining their closed state, whereby they are completely received in the case 10. In this instance, since the pieces 32 and levers 28 are always engaged with each other through the engaging arm 36 of the piece 32 and the long guide groove 30 of the lever 28, the sunken state of the levers 28 with respect to the case 10 is also locked by this piece 32. Thus, it follows that the scissors have a packing case in advance and can be stored in an extremely safe state and the scissors thus stored can be put in the pocket of the garment or in the bag and carried about without any danger.

Reversely, in making a switch from the state of non-use shown in FIGS. 6 through 9 to the state of use shown in FIGS. 1 through 5, it is only necessary for the user to slide the pivot 34 of the pieces 32 forwardly. Since the levers 28 and pieces 32 are under the action of the coil springs 38, this slide movement causes them to spread out from the case 10 in unison. At any rate, the sunken state and extended state of the pieces 32 and levers 28 with respect to the case 10 can be smoothly and correctly switched from one to the other in the nimble operation provided by the so-called single finger-touch action using a finger tip of one hand.

FIGS. 10 through 15 show a modified form of scissors, which differs from the aforesaid basic form shown in FIGS. 1 through 9 in the following points:

First, the cover case 10 is omitted and the function of the case 10 is performed by levers 28A. To this end, the contour of the levers 28A in their closed state is made substantially the same as that of said case 10, and an elongated slide hole 22A for sliding the pivot 34A of pieces 32A is defined between the opposed levers 28 so that it is throughgoing. Thus, it follows that the slide guide groove 20 of the case body 12 described with reference to said basic form is replaced by the elongated guide throughgoing hole 20A, which, however, has the same function.

Secondly, the bolt 40A forming the pivot 34A of the pieces 32A is exposed to the outside, and its head has the same shape as that of the grip portion of the cap nut 42A and is adapted to be pressed against the outer surfaces of the lateral walls of the levers 28A. Thus, it is the same as before that the pivot 34A in this modified form consists of a screw clamp body, and it is possible to lock the pieces 32A to prevent their slide movement by tightening up the nut 42A.

Thirdly, in this modified form, the pair of levers 28A serving the function of the case 10 are pivotally connected together at their front ends by a plate spring 38A, which constantly resiliently urges the levers 28A to spread out. In this instance, since the levers 28A and pieces 32A are engaged with each other in the same manner as in said basic form so that the latter are slidable relative to the former, it follows that the force of the spring 38A is also borne by the pieces 32A. That is, the levers 28A and pieces 32A are operatively connected together, as before, so that by sliding the pivot 34A of the pieces 32A, it is possible to open or close the pieces 32A and levers 28A in unison so as to make a switch between the opened and closed states. In this modified form, since the other arrangements and functions are substantially the same as those of the basic form shown in FIGS. 1 through 9, the members or portions in FIGS. 10 through 15 which are functionally the same as those shown in FIGS. 1 through 9 are simply marked with similar characters (like characters in FIGS. 1–9 with the suffix "A" applied thereto) and a detailed description thereof is omitted.

In either case, according to the present invention, the various objects previously mentioned can be achieved by providing a simple assembly comprising parts capable of mass-production. The invention is applicable not only to the illustrated scissors but also to other various tools such as pliers, nippers, and strippers. Thus, the invention is very useful.

What is claimed is:

1. A hand-held type opening and closing action tool, comprising:

an arcuate spring;

upper and lower elongated operating levers having front and rear ends, said front ends being pivotally connected by said spring, such that the action of said spring biases said rear ends apart and said rear ends contact each other when pressed together, said levers presenting an elongated guide hole therebetween when closed when said rear ends are touching each other;

right and left front active pieces, each having a rear mounting portion;

a clamping pivot pin extending transversely through said active pieces at a point adjacent said rear mounting portions for pivotally connecting said active pieces together such that said active pieces form an X-shaped assembly for scissor-type action, said pivot pin also extending transversely across said elongated guide hole; and engagement means for slidably engaging said rear mounting portions with said elongated levers such that the active pieces are operatively connected with and operable for opening and closing operation by said elongated levers, and such that in the closed state, said pivot pin may be moved rearwardly from a position near said spring to a position near said rear ends to retract said closed active pieces within with said elongated levers.

2. The hand-held type opening and closing action tool of claim 1, wherein said pivot pin includes a nut and a bolt engaging each other such that said active pieces are slidably locked by pressing the head of said bolt and said nut against outer surfaces of said elongated levers by relative tightening of said nut and bolt.

3. The hand-held type opening and closing action tool of claim 2, wherein said nut and said bolt each have a thumb-engaging button thereon.

4. The hand-held type opening and closing action tool of claim 1, wherein said engagement means includes an engaging arm on each of said rear mounting portions having a lip extending transverse thereto and engaged with a longitudinal groove extending along the length of each of said operating levers.

5. The hand-held type opening and closing action tool of claim 1, wherein said upper and lower operating levers are identical with one another and may be interchanged therewith.

6. The hand-held type opening and closing action tool of claim 1, wherein said right and left front active pieces are identical with one another and may be interchanged therewith.

* * * * *